US010086406B2

(12) United States Patent
Charreyre

(10) Patent No.: US 10,086,406 B2
(45) Date of Patent: Oct. 2, 2018

(54) MACHINE FOR SORTING A MIXTURE OF WASTE, AND ASSOCIATED SORTING METHOD

(71) Applicant: FINANCE DEVELOPPEMENT ENVIRONNEMENT CHARREYRE-FIDEC, Polignac (FR)

(72) Inventor: Fabien Michel Alain Charreyre, Allegre (FR)

(73) Assignee: FINANCE DEVELOPMENT ENVIRONMENT CHARREYRE—FIDEC, Polignac (FR)

( * ) Notice: Subject to any disclaimer, the term of this patent is extended or adjusted under 35 U.S.C. 154(b) by 0 days.

(21) Appl. No.: 15/313,459

(22) PCT Filed: May 22, 2015

(86) PCT No.: PCT/FR2015/051372
§ 371 (c)(1),
(2) Date: Nov. 22, 2016

(87) PCT Pub. No.: WO2015/197928
PCT Pub. Date: Dec. 30, 2015

(65) Prior Publication Data

US 2017/0151585 A1 Jun. 1, 2017

(30) Foreign Application Priority Data

May 23, 2014 (FR) ..... 14 54709

(51) Int. Cl.

| | |
|---|---|
| ***B07B 1/24*** | (2006.01) |
| ***B07B 1/22*** | (2006.01) |
| ***B07B 13/04*** | (2006.01) |

(52) U.S. Cl.
CPC ..... *B07B 1/24* (2013.01); *B07B 1/22* (2013.01); *B07B 13/04* (2013.01)

(58) Field of Classification Search
CPC ..... B07B 1/22; B07B 1/24; B07B 13/04
(Continued)

(56) References Cited

U.S. PATENT DOCUMENTS

| | | | | |
|---|---|---|---|---|
| 5,009,370 | A * | 4/1991 | Mackenzie | B03B 9/06 209/19 |
| 5,108,584 | A * | 4/1992 | Brosseuk | B03B 5/26 209/270 |
| 6,019,227 | A * | 2/2000 | May, III | A01K 67/0332 209/284 |

FOREIGN PATENT DOCUMENTS

| | | |
|---|---|---|
| EP | 2 253 388 A1 | 11/2010 |
| ES | 2 298 094 A1 | 5/2008 |

(Continued)

OTHER PUBLICATIONS

International Search Report dated Sep. 24, 2015 issued in corresponding International Application No. PCT/FR2015/051372.

*Primary Examiner* — Terrell H Matthews
(74) *Attorney, Agent, or Firm* — Nath, Goldberg & Meyer; Jerald L. Meyer

(57) ABSTRACT

The invention concerns a rotary machine (1) for sorting a mixture of wastes (2), said sorting machine (1) being characterized in that it comprises at least:

a first trammel section (3), provided with a first separation wall (5) extending over a first length (L1) allowing separating the mixture of wastes (2) into a first fraction of wastes (13) getting through said first separation wall (5) and into a residual second fraction of wastes (14), and a second trammel section (4), provided with a second separation wall (6) extending over a second length (L2)

(Continued)

smaller than the first length (L1), and allowing separating the residual second fraction of wastes (14) into a subfraction of small-sized wastes (15) getting through said second separation wall (6) and into a residual subfraction of large-sized wastes (16).

Wastes sorting.

21 Claims, 2 Drawing Sheets

(58) Field of Classification Search
USPC ..... 209/297
See application file for complete search history.

(56) References Cited

FOREIGN PATENT DOCUMENTS

| | | | | | |
|---|---|---|---|---|---|
| FR | 548.985 | A | | 1/1923 | |
| FR | 2 668 398 | A1 | | 4/1992 | |
| GB | 127783 | A | * | 6/1919 | ..... B07B 1/18 |
| GB | 127783 | A | | 6/1919 | |
| GB | 247315 | A | * | 2/1926 | ..... B07B 1/18 |
| GB | 247315 | A | | 2/1926 | |
| GB | 2466215 | A | | 6/2010 | |
| KR | 2001-0089073 | A | | 9/2001 | |
| WO | WO-2007136228 | A1 | * | 11/2007 | ..... B07B 1/56 |

* cited by examiner

MACHINE FOR SORTING A MIXTURE OF WASTE, AND ASSOCIATED SORTING METHOD

This is a National Phase Application filed under 35 U.S.C. 371 as a national stage of PCT/FR2015/051372, filed May 22, 2015, an application claiming the benefit of French Application No. 1454709, filed May 23, 2014, the content of each of which is hereby incorporated by reference in its entirety.

TECHNICAL FIELD

The present invention concerns the field of sorting, and in particular the automatization of sorting by means of a rotary machine, in particular to perform sorting of wastes, in order to treat them, in particular to recycle them or to valorize them.

The invention concerns more specifically a rotary machine for sorting a mixture of wastes, the latter being with heterogeneous sizes, shapes and consistencies, the mixture of wastes comprising at least biodegradable wastes and non-biodegradable recyclable wastes.

The invention also concerns a method for sorting a mixture of wastes with heterogeneous sizes, shapes and consistencies, comprising at least biodegradable wastes and non-biodegradable recyclable wastes, a non-negligible portion of the mass of the mixture of wastes being formed by biodegradable wastes, for example at least 10% of the mass, and a non-negligible portion of the mass of the mixture being formed by non-biodegradable recyclable wastes, for example at least 10% of the mass.

PRIOR ART

In order to perform sorting of a mixture of dirty, sticky objects, or having a strong tendency to clog, or still a mixture of heavy objects such as gravels, it is possible to use a rotary trommel. The known rotary trommels are generally formed by a sieving enclosure rotating about its longitudinal axis, which is slightly inclined with respect to the horizontal, the wall of the sieving enclosure being provided with calibrated separation through orifices. Thanks to these orifices, the wall of the enclosure allows performing a segregation of the objects by size, allowing separating, on the one hand, passing objects, the size of which is smaller than the size of the separation orifices, and on the other hand, rejected objects, the size of which is larger than the size of the meshes of the separation orifices. Thus, when introducing objects to be sorted inside the enclosure, for example at a first end thereof, there are formed a flow of objects passing through the separation wall, and a flow of rejected objects, which are generally intended to come out through the second end of said enclosure. The objects to be sorted generally circulate in the enclosure under the effect of gravity, the first end being placed higher than the second end.

Though this type of known rotary trommel is generally satisfactory for some types of objects, it seems that it could be improved to allow a better separation of the objects, in particular for waste-type objects, the segregation of which by type (biodegradable wastes, non-biodegradable recyclable wastes, non-recyclable wastes) is often made difficult due to their large heterogeneity of size, shape, consistency and of density, as well as their character generally sticky or greasy.

DISCLOSURE OF THE INVENTION

Consequently, the objects assigned to the present invention aim to remedy to the different drawbacks enumerated hereinbefore and to propose a new sorting machine and a new sorting method allowing sorting a particularly heterogeneous mixture of wastes in an effective manner.

Another object of the invention aims to propose a new sorting machine and a new sorting method allowing sorting domestic wastes, wastes of economic or industrial activities in an effective manner.

Another object of the invention aims to propose a new sorting machine and a new sorting method allowing ensuring a high-quality sorting.

Another object of the invention aims to propose a new sorting machine and a new sorting method which are particularly versatile and universal.

Another object of the invention aims to propose a new sorting machine and a new sorting method which are inexpensive and easy to implement.

Another object of the invention aims to propose a new sorting machine the maintenance of which is particularly easy.

Another object of the invention aims to propose a new sorting machine and a new sorting method for which the risk of clogging is particularly low.

The objects assigned to the invention are achieved by means of a rotary machine for sorting a mixture of wastes, the latter being with heterogeneous sizes, shapes and consistencies, the mixture of wastes comprising at least biodegradable wastes and non-biodegradable recyclable wastes, said sorting machine being characterized in that it comprises at least:

- a first trommel section, provided with a first separation wall extending over a first axial length and being provided with a first series of separation through orifices allowing separating the mixture of wastes into a first fraction of wastes getting through said first separation wall via the first series of separation orifices and into a residual second fraction of wastes, the mixture of wastes being intended to circulate along said first wall so as to be separated, and
- a second trommel section, provided with a second separation wall extending over a second axial length smaller than the first length, said second separation wall being provided with a second series of separation through orifices allowing separating the residual second fraction of wastes into a subfraction of small-sized wastes getting through said second separation wall via said second series of separation orifices and into a residual subfraction of large-sized wastes, the subfraction of large-sized wastes being formed by wastes the size of which is larger than the subfraction of small-sized wastes, the residual second fraction of wastes being intended to circulate along said second wall so as to be separated.

The objects of the invention are also achieved by means of a sorting method for sorting a mixture of wastes with heterogeneous sizes, shapes and consistencies, comprising at least biodegradable wastes and non-biodegradable recyclable wastes, a non-negligible portion of the mass of the mixture of wastes being formed by biodegradable wastes, for example at least 10% of the mass, and a non-negligible portion of the mass of the mixture being formed by non-biodegradable recyclable wastes, for example at least 10% of the mass, said sorting method being characterized in that, it includes the following successive steps:

- introducing the mixture of wastes into a first trommel section, provided with a first separation wall extending over a first axial length and being provided with a first series of separation through orifices, separating the mixture of wastes into a first fraction of wastes getting through said first separation wall via the first series of separation orifices and into a residual second fraction of residual wastes, the mixture of wastes circulating along said first wall so as to be separated, making the residual second fraction of wastes pass from the first trommel section to a second trommel section, provided with a second separation wall extending over a second axial length smaller than the first length, said second separation wall being provided with a second series of separation through orifices, separating the residual second fraction of wastes into a subfraction of small-sized wastes getting through said second separation wall via said second series of separation orifices and into a residual subfraction of large-sized wastes, the subfraction of large-sized wastes being formed by wastes the size of which is larger than the subfraction of small-sized wastes, the residual second fraction of wastes being intended to circulate along said second wall so as to be separated.

BRIEF DESCRIPTION OF THE DRAWINGS

Other particularities and advantages of the invention will appear and will come out in more detail upon reading the description made hereinafter, with reference to the appended drawings, given only as an illustrative and non-limiting example, in which.

BEST WAY TO REALIZE THE INVENTION

The invention concerns, as such, a rotary machine 1 for sorting a mixture of wastes 2. The purpose of this sorting machine 1 of the invention is to organize the wastes of said mixture of wastes 2, by classifying and separating the contained wastes into categories based on their nature or their intrinsic characteristics. In this manner, the wastes sorted by the sorting machine 1 may advantageously undergo subsequent treatments, for example treatments which would have not been possible to perform when said wastes are at the initial state of a mixture of wastes 2, such as recycling, composting, or conversion into a refuse-derived fuel.

Figure 1:
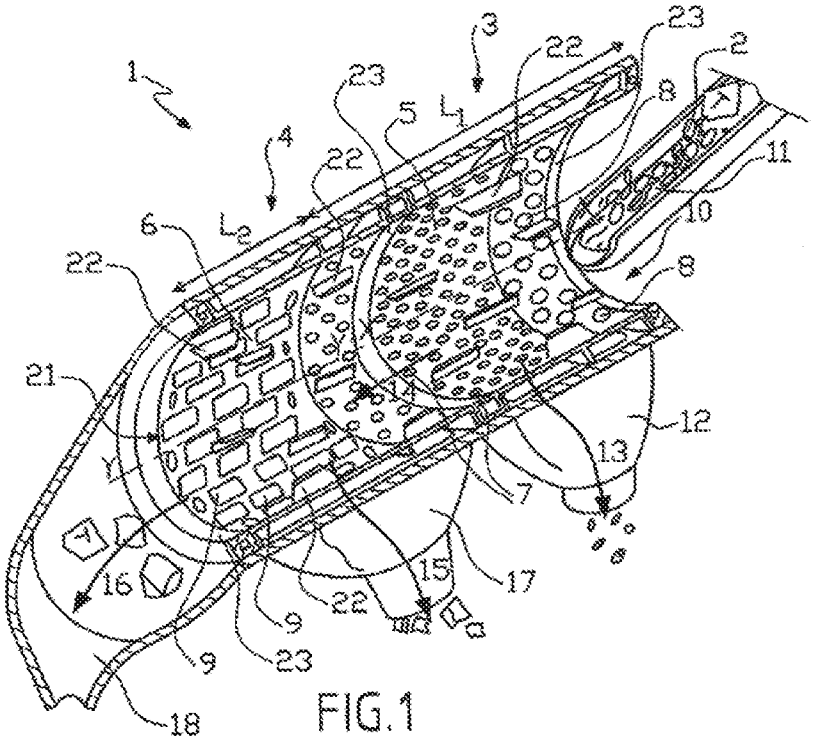
FIG. 1 represents, according to a schematic perspective view, a longitudinal section of the sorting machine according to the invention, showing in particular the inside of a first and a second trommel section of said sorting machine including respectively a first separation wall and a second separation wall.

A non-exhaustive and non-limiting embodiment of a sorting machine 1 in accordance with the invention is illustrated in FIG. 1. Such a sorting machine 1 is advantageously implemented in an industrial method for treating wastes.

Preferably, the mixture of wastes 2 is formed by domestic wastes, but it may be also formed by wastes of economic or industrial activities, or by both, said wastes not having undergone any prior sorting, or grinding. Thus, this mixture of wastes 2 is advantageously formed by wastes generated by households, by their consumption and by their daily life.

Preferably, the mixture of wastes 2 has not undergone any treatment and forms a raw mixture of wastes 2. In particular, the raw mixture of wastes has not undergone any grinding, nor does it have undergone any prior sorting aiming to perform a segregation of one type of wastes from another, and in particular to perform a separation of the biodegradable wastes and of the non-biodegradable recyclable wastes. Preferably, the mixture of wastes 2 has been collected, for example by means of garbage trucks, from households and/or economic activities without said households and/or said economic activities having performed any sorting or prior selection of the collected wastes. In particular, the collection of the mixture of wastes 2 has not been selective. Thus, according to a particularly interesting variant of the invention, the method of the invention is a method for treating a raw mixture of non-ground wastes.

Of course, without departing from the scope of the invention, the mixture of wastes 2 may have been deprived, on the contrary, from a portion of the contained recyclable wastes, for example by the households during a preliminary sorting, or it may have undergone a preliminary sorting, for example by the households.

Advantageously, the wastes of the mixture of wastes 2 are collected in a raw and undifferentiated way, mixed in bags, such as plastic trash bags closed by the households, the method including a preliminary step of opening said bags in order to individually release the wastes they contain so as to form the mixture of wastes 2 according to the invention, which is a grouping of the wastes initially contained in said bags. Opening of the wastes bags may be performed for example using a bag opening device, in order to allow the release of wastes out of said bags, preferably without damaging or altering said wastes.

In particular, because of the absence of any preliminary sorting before the entry of the mixture of wastes 2 in the treatment method of the invention, the wastes present heterogeneous sizes, shapes and consistencies, preferably with various natures and origins. In particular, the considered mixture of wastes 2 may comprise, at the same time, soft, hard, sharp, liquid, powdery, solid, flat, hollow, full, sticky, slippery, fat, breakable, flexible, compressible, incompressible, combustible, incombustible wastes, or still wastes cumulating several of these characteristics. The mixture of wastes 2 contains a major portion of used and undesirable elements, for example food wastes, newspapers, papers, cardboards, glass, plastic, metal, textiles, various combustibles and incombustibles, complex materials, households hazardous wastes, inert wastes, bulky wastes.

According to the invention, the mixture of wastes 2 comprises at least biodegradable wastes and non-biodegradable wastes, the biodegradable wastes advantageously forming a non-negligible portion of the mixture of wastes 2, for example at least 10% of the mass of the latter.

Advantageously, at least 10%, preferably at least 20%, of the mass of the mixture of wastes 2 is formed by biodegradable wastes, and at least 10, preferably at least 20%, of the mass of the mixture is formed by non-biodegradable recyclable wastes.

By «biodegradable waste», is meant, in the context of the invention, a waste which, under the action of a natural environment, comprising for example living organisms and/or air and/or water, can be decomposed, naturally and spontaneously, into various elements likely to cause damages to the natural environment (high demand for oxygen, emission of leachates) unless being stabilized for example by composting. In particular, the living organisms may be formed by micro-organisms such as bacteria, funguses or algae, which are likely to degrade the biodegradable wastes through biochemical reactions. Preferably, by «biodegradable wastes», are meant wastes which can be degraded in this manner within a human lifetime, in a decade, or more preferably in one year or in a few months, preferably in a few weeks. Preferably, by «biodegradable wastes», are meant wastes which are likely to be used in the production and the formation of a compost by composting the latter.

The «non-biodegradable« wastes, in the context of the invention, constitute the other wastes, which do not undergo, spontaneously and naturally, such a degradation, or which undergo such a degradation in a too slow way. In particular, the «non-biodegradable» wastes are not adapted to enter into the formation of a compost by composting the latter.

A «recyclable» waste, in the context of the invention, forms a waste which may be easily transformed, for example chemically or mechanically, so as to form a recycled matter similar to a raw material, which may be used for example in the manufacture of an object. Preferably, the term «recyclable waste» excludes the biodegradable wastes, even though in practice their transformation into a compost confers a recyclable character to them. In the context of the invention, the recyclable wastes may comprise for example:

- non-metallic wastes, in particular polymers, glass, papers, cardboard, newspapers, gravels, wood, textiles, electronics, etc.
- metallic wastes, formed by any type of metals.

In the context of the invention, the term «non-recyclable wastes» refers to any waste which does not fall in any of the categories described hereinabove of «recyclable wastes» and «biodegradable wastes». In particular, the non-recyclable wastes regroup in particular wastes presenting a calorific value which makes them likely to be transformed into refuse-derived fuels, and other unusable ultimate wastes (complex wastes, etc.) intended for example to be buried or incinerated.

According to the invention, the sorting machine 1 comprises at least one first trammel section 3, provided with a first separation wall 5 extending over a first axial length L1 and being provided with a first series of separation through orifices 7, 8 allowing separating the mixture of wastes 2 into a first fraction of wastes 13 getting through said first separation wall 5 via the first series of separation orifices 7, 8 and into a residual second fraction of wastes 14, the mixture of wastes 2 being intended to circulate along said first wall so as to be separated.

The first trommel section 3 is designed to receive therein the mixture of wastes 2 in order to perform a first sorting of the latter. Said first trammel section 3 of the invention is intended to bring the mixture of wastes 2 into contact with the first separation wall 5. At contact with the latter, the mixture of wastes 2 is sieved, and/or filtered, said first separation wall 5 being porous, so as to allow the passage of the first fraction of wastes 13 therethrough, and to prevent the passage of the residual second fraction of wastes 14 therethrough. Preferably, the first fraction of wastes 13 is formed by wastes the average size of which is smaller than those of the residual second fraction of wastes 14.

The separation orifices 7, 8 of the first series of separation orifices 7, 8 are formed throughout the first separation wall 5, so as to make it porous, and are calibrated so as to let only the first fraction of wastes 13 pass therethrough, in the same manner as a sieve, the elements of which fraction are finer than those of the residual second fraction of wastes 14.

The mixture of wastes 2 is intended to evolve, for example by gravity, along the first separation wall 5 over the entire first length L1. Advantageously, the latter represents the porous length of the first separation wall 5, that is to say the effective length pierced by the first series of separation orifices 7, 8.

The first fraction of wastes 13 is discharged from the first trommel section 3, for example by gravity, in a first hopper 12 placed below the first trammel section 3. Advantageously, the residual second fraction of wastes 14 remains channeled within the first trommel section 3, and is brought to pass in the second trommel section 4.

To the extent that the mixture of wastes 2 first passes in the first trommel section 3, the latter preferably allows separating the wastes the volumetric mass of which is the heaviest, the dynamic inertia of which is the highest, the most sticky, fat, dirty and moist wastes of the mixture of wastes 2. Thus, the first fraction of wastes 13 is advantageously formed mostly by wastes presenting such properties. In this instance, the first fraction of wastes 13 therefore concentrates mostly organic and/or biodegradable wastes, which present the aforementioned properties most of the time. Thus, preferably, a non-negligible portion of the mass of the first fraction of wastes 13 is formed by biodegradable wastes, for example at least 50% of the mass of the first fraction of wastes 13, or still at least 60%, or still preferably at least 80%. Besides, a non-negligible portion of the mass of the residual second portion of wastes 14 is advantageously formed by non-biodegradable recyclable wastes, which may possibly be separated and recovered later on.

Advantageously, the first fraction of wastes 13 may be subjected to a composting method including in particular the following successive steps:

- Step A: the first fraction of wastes 13 is subjected to a first composting cycle so as to compost, at least partially, the biodegradable wastes of said first fraction of wastes 13, and to obtain a mixture of pre-composted wastes,
- Step B: the mixture of pre-composted wastes is subjected to a drying so as to obtain a mixture of dried wastes,
- Step C: the mixture of dried wastes is separated into at least one portion of heavy wastes and one portion of light wastes, the portion of heavy wastes being formed by wastes with a volumetric mass heavier than the wastes of the portion of light wastes, the heavy wastes may undergo a recycling,
- Step D: the portion of light wastes is subjected to a second composting cycle so as to compost, at least partially, the contained biodegradable wastes, and to obtain a mixture of refined wastes, preferably complying with the standard NF U 44-051. The standard NF U 44-051 of 2006, named «Organic amendments—Denominations, specifications and markings», is a French standard.

Of course, without departing from the scope of the invention, the first fraction of wastes 13 may be differently treated.

Figure 2:
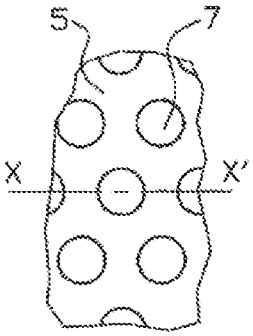
FIG. 2 represents, according to a schematic front view, a detail of an embodiment of the first separation wall of FIG. 1.
Figure 3:
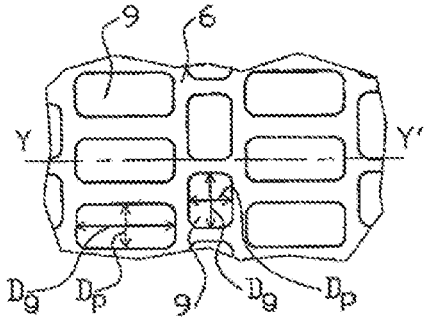
FIG. 3 illustrates, according to a schematic front view, a detail of an embodiment of the second separation wall of FIG. 1
Figure 4:
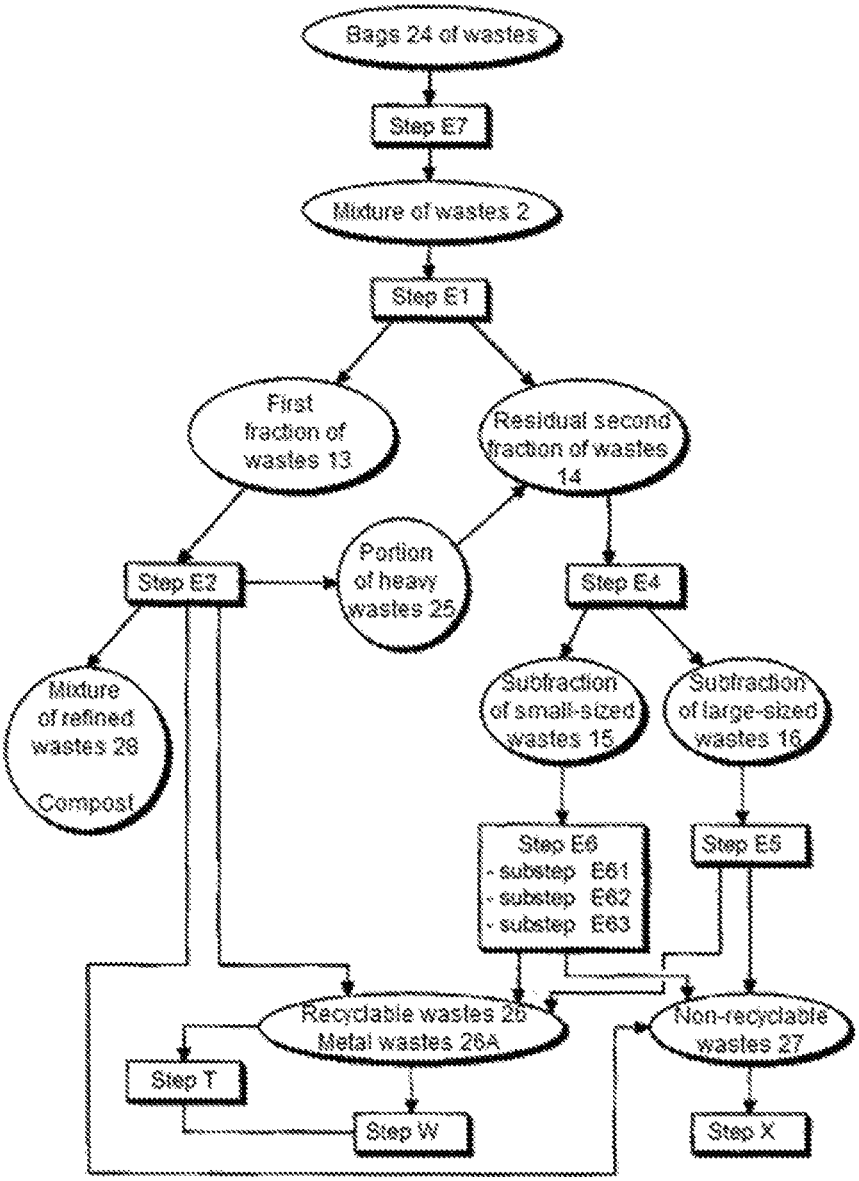
FIG. 4 illustrates a method for treating wastes in which the sorting machine of FIGS. 1 to 3 may advantageously be used.

Preferably, as illustrated in FIGS. 1 and 2, the first series of separation orifices 7, 8 comprises at least primary orifices 7 at least contributing to the separation of the mixture of wastes 2 into the first fraction of wastes 13 and into the residual second fraction of wastes 14 by passage of the first fraction of wastes 13 throughout said primary orifices 7, the latter being with a size adapted to prevent the passage of wastes with a size larger than 80 mm. Thus, in this preferred case, only the sufficiently small-sized wastes are allowed to pass throughout the primary orifices 7, so as to form the first fraction of wastes 13. Preferably, the chosen size of the primary orifices 7 allows performing a high-quality selection of the biodegradable wastes, that is to say that it allows obtaining a high concentration of biodegradable wastes in the first fraction of wastes 13. To this end, the section of the primary orifices 7 is preferably circular, and with a diameter comprised between 85 mm and 95 mm, preferably about 90 mm. It should be noted that, in particular in order to adapt to the composition of the mixture of wastes 2, other sizes and shapes of primary orifices 7 may be considered without departing from the scope of the invention, for example a polygonal shape, an oblong shape, a smaller size, or a larger size.

Advantageously, the primary orifices 7 are evenly distributed, so as to form a meshing, over a major portion of the surface of the first separation wall 5.

Advantageously, and as illustrated in FIG. 1, the first series of separation orifices 7, 8 also comprises secondary orifices 8 contributing to the separation of the mixture of wastes 2 into the first fraction of wastes 13 and into the residual second fraction of wastes 14 by passage of the first fraction of wastes 13 throughout said secondary orifices 8, the latter having a size adapted to enable the passage of wastes the size of which is comprised between 1 times and 1.5 times the size of the wastes the passage of which is enabled by the primary orifices 7, the secondary orifices 8 being disposed upstream of the primary orifices 7, with regards to the flow direction of the mixture of wastes 2.

In contrast with common trommels, the first separation wall 5 advantageously presents a porosity decreasing along its first length L1 so that the mixture of wastes 2 is brought into contact first with the secondary orifices 8, and then with the primary orifices 7, the size of the secondary orifices 8 being larger than the size of the primary orifices 7. Preferably, the section of the secondary orifices 8 is circular, with a diameter comprised between 105 mm and 115 mm, preferably about 110 mm. It should be noted that, in particular in order to adapt to the composition of the mixture of wastes 2, other sizes and shapes of secondary orifices 8 may be considered without departing from the scope of the invention, for example a polygonal shape, an oblong shape, a smaller size, or a larger size.

Preferably, the secondary orifices 8 are evenly distributed, so as to form a meshing, over a minor portion of the surface of the first separation wall 5 which is unoccupied by the primary orifices 7. Advantageously, the secondary orifices 8 are distributed over about one eighth of the first length L1, the primary orifices 7 occupying substantially all the remaining length.

Distributed over such a short length, the secondary orifices 8 allow including to the first fraction of wastes 13 only a portion of wastes with a size larger than the size allowed by the primary orifices 7 and contained in the mixture of wastes 2. In a particularly advantageous manner, such a design allows ensuring that the residual second fraction of wastes 14 contains a lesser proportion, or still a substantially zero proportion, of biodegradable wastes, even though a more considerable portion of non-biodegradable wastes is likely to be introduced in the first fraction of wastes 13.

Consequently, preferably, a non-negligible portion of the mass of the residual second fraction of wastes 14 is formed by recyclable wastes, for example at least 50% of the mass of the residual second fraction of wastes 14, or still at least 60%, or still preferably at least 80%. Besides, a non-negligible portion, but as reduced as possible, of the mass of the first fraction of wastes 13 is advantageously formed by biodegradable wastes, which may possibly be separated and recovered later on. Preferably, at this stage, less than 40% of the mass of the residual second fraction of wastes 14 is formed by biodegradable wastes, preferably less than 25%, or still less than 10%.

According to the invention, the sorting machine 1 also comprises a second trommel section 4, provided with a second separation wall 6 extending over a second axial length L2, said second separation wall 6 being provided with a second series of separation through orifices 9 allowing separating the residual second fraction of wastes 14 into a subfraction of small-sized wastes 15 getting through said second separation wall 6 via said second series of separation orifices 9 and into a residual subfraction of large-sized wastes 16, the subfraction of large-sized wastes 16 being formed by wastes the size of which is larger than the subfraction of small-sized wastes 15, the residual second fraction of wastes 14 being intended to circulate along said second wall so as to be separated.

The second trommel section 4 is designed to receive therein the residual second fraction of wastes 14, coming from the first trommel section 3, so as to perform a second sorting of said residual second fraction of wastes 14. The second trommel section 4 is intended to bring the residual second fraction of wastes 14 into contact with the second separation wall 6. At contact with the latter, the residual second fraction of wastes 14 is sieved, and/or filtered, said second separation wall 6 being porous, so as to enable the passage of the subfraction of small-sized wastes 15 therethrough, and to prevent the passage of the subfraction of large-sized wastes 16 therethrough.

The separation orifices 9 of the second series of separation orifices 9 are formed throughout the second separation wall 6, so as to make it porous, and are calibrated so as to let only the subfraction of small-sized wastes 15 pass therethrough, in the same manner as a sieve, the elements of which subfraction are finer than those of the subfraction of large-sized wastes 16.

The residual second fraction of wastes 14 is intended to evolve, for example by gravity, along the second separation wall 6 over the entire second length L2. Advantageously, the latter represents the porous length of the second separation wall 6, that is to say the effective length pierced by the second series of separation orifices 9.

As illustrated in FIG. 1, the subfraction of small-sized wastes 15 is discharged from the second trommel section 4, for example by gravity, in a second hopper 17 placed below the second trommel section 4. Preferably, the subfraction of large-sized wastes 16 remains channeled within the second trommel section 4 and is discharged from the latter. For this purpose, the second trommel section 4 preferably presents a discard output through which the subfraction of large-sized wastes 16 is intended to come out from said second trommel section 4. Advantageously, the discard output 21 opens into a discharge hopper 18 connected to the end of the second trommel section 4, and in which the subfraction of large-sized wastes 16 falls by gravity.

To the extent that the residual second fraction of wastes 14 is preferably substantially devoid of biodegradable wastes, dirty, sticky and/or with a high volumetric mass, which have been discarded by the first trommel section 3, the second trommel section 4 preferably allows performing a sorting of the wastes, including in particular recyclable wastes, present in the residual second fraction of wastes 14. In particular, it preferably allows isolating wastes with a relatively considerable size contained in the subfraction of large-sized wastes 16, which would undergo for example a manual sorting aiming to separate the biodegradable wastes, the recyclable wastes and the non-recyclable wastes. Advantageously, the smaller wastes contained in the subfraction of small-sized wastes 15 may in turn undergo for example an automated sorting aiming to separate the biodegradable wastes, the recyclable wastes and the non-recyclable wastes. In any case, the subsequent sortings performed on the subfraction of small-sized wastes 15 and on the subfraction of large-sized wastes 16 are advantageously facilitated, to the extent that, at this stage, the wastes are substantially cleared from the organic and/or biodegradable, sticky, dirty and foul wastes.

Preferably, the second series of separation orifices 9 comprises at least tertiary orifices 9 at least contributing to the separation of the residual second fraction of wastes 14 into the subfraction of small-sized wastes 15 and into the subfraction of large-sized wastes 16 by passage of the subfraction of small-sized wastes 15 throughout said tertiary orifices 9, the latter being with a size adapted to prevent the passage of wastes with a size larger than at least 200 mm, or still 300 mm. Thus, in this preferred case, only the sufficiently small-sized wastes are allowed to pass throughout the tertiary orifices 9, so as to form the subfraction of small-sized wastes 15. Preferably, the chosen size of the tertiary orifices 9 allows performing a selection of a predetermined type of recyclable wastes, that is to say that it allows obtaining a high concentration of this particular type of recyclable wastes in the subfraction of small-sized wastes 15. To do so, the section of the tertiary orifices 9 is advantageously oblong-shaped, and said oblong section presenting a small diameter Dp, and a large diameter Dg, as illustrated in particular in FIG. 6. Preferably, the expression «oblong section« includes for example a section shape which is rectangular or elliptical, or a shape combining the characteristics of the latter. Advantageously, the large diameter Dg and the small diameter Dp are chosen so as to correspond to types of wastes which are desired to be included in particular in the subfraction of small-sized wastes 15. For example, the mixture of wastes 2 being likely to contain plastic or glass bottles, generally with a thirty-centimeter standard size, it is possible to choose a large diameter Dg with a slightly larger size than the size of said bottles, that is to say slightly larger than thirty centimeters. Similarly, for example, the mixture of wastes 2 being likely to contain used newspapers, generally with a twenty-centimeter standard size, it is possible to choose a small diameter Dp with a slightly larger size than the size of said newspapers, that is to say slightly larger than twenty centimeters.

Consequently, for each tertiary orifice, the small diameter Dp is preferably comprised between 200 and 240 mm, preferably about 220 mm, the large diameter Dg being comprised between 300 and 400 mm, preferably about 330 mm, the small diameter Op being substantially perpendicular to the large diameter Dg, as illustrated in particular in FIG. 6. Of course, in particular in order to adapt to the composition of the initial mixture of wastes 2, other sizes and shapes of tertiary orifices 9 may be considered without departing from the scope of the invention, for example a polygonal shape, a circular shape, a smaller size, or a larger size.

Advantageously, as illustrated in FIG. 6, the tertiary orifices 9 are distributed in successive rows along the second length L2, by alternating at least:

- a longitudinal row 19 of tertiary orifices 9, in which the large diameter Dg of the tertiary orifices 9 of the straight row is aligned in the direction of the second length L2, and
- a transverse row 20 of tertiary orifices 9, in which the small diameter Dp of the tertiary orifices 9 of the transverse row 20 is aligned in the direction of the second length L2.

Preferably, the large diameter Dg of the tertiary orifices 9 is parallel to the second longitudinal axis Y-Y' of the second trommel 4, as described below. On the contrary, the large diameter Dg of the tertiary orifices 9 is preferably perpendicular to the second longitudinal axis Y-Y'.

Thus, from one row to another, the tertiary orifices 9 are preferably substantially perpendicular to each other, so as to anticipate the orientation of the wastes to be included in the subfraction of small-sized wastes 15, and to improve the sorting effectiveness of the second trommel section 4

Preferably, the second series of separation orifices 9 will be formed by an alternation of longitudinal rows 19 and transverse rows 20 of tertiary orifices 9.

Of course, other arrangements of the tertiary orifices may be considered without departing from the scope of the invention.

Advantageously, the first series of separation orifices 7, 8 is distributed substantially over the entire first length L1 of the first trommel section 3, the second series of separation orifices 9 is distributed substantially over the entire second length L2 of the second trommel section 4, so as to be distributed over at least most of, or still the entire, surface formed by the first separation wall 5 and by the second separation wall 6. Such a design allows increasing the effective proportion of said separation walls, and therefore improving the compactness of the sorting machine 1 in a general manner.

According to a particularly important feature of the invention, the second length L2 is smaller than the first length L1. Thus, the first trommel section 3, and in particular the second separation wall 5 has a length greater than the second trommel section 4, and in particular the second separation wall 6. Such a design allows the first trommel section 3 to effectively ensure the separation of most of, or still all, the biodegradable wastes initially contained in the mixture of wastes 2. Indeed, the first length L1 is advantageously chosen so as to be long enough so that all the wastes of the mixture of wastes 2 likely to get through the first separation wall 5 are effectively included in the first fraction of wastes 13.

Preferably, the first length L1 is at least 1.05 times the second length L2, preferably at least 1.10 times, still more preferably at least 1.12 times. Advantageously, the sum of the first length L1 and of the second length L2 is between 10 and 20 m. Preferably, the sorting machine 1 is designed to sort between 10 and 50 T/h of a mixture of wastes (2).

Advantageously:

- the first fraction of wastes 13 represents between 35 and 60% of the mass of the initial mixture of wastes 2, preferably about 42%,
- the subfraction of small-sized wastes 15 represents between 20 and 40% of the mass of the initial mixture of wastes 2, preferably about 28%,
- the subfraction of large-sized wastes 16 represents between 20 and 40% of the mass of the initial mixture of wastes 2, preferably about 30%.

Preferably, as represented for example in FIG. 1, the first separation wall 5 presents a general shape of a prism, a cylinder or a truncated cone, the height of which forms a first longitudinal axis X-X' of the first separation wall 5, the latter being rotated around the first longitudinal axis X-X'.

Advantageously, the second separation wall 6 presents a general shape of a prism, a cylinder or a truncated cone, the height of which forms a second longitudinal axis Y-Y' of the second separation wall 6, the latter being rotated around the second longitudinal axis Y-Y'.

Preferably, the first longitudinal axis X-X' and/or the second longitudinal axis Y-Y' are slightly inclined with respect to the horizontal, so as to enable a progression, by gravity, of the wastes in the trommel sections along a predetermined flow direction, advantageously from the inlet 10, towards the second trommel section 4, to the discharge hopper 18 at the discard output of the second trommel section 4.

The rotation of the first trommel section 3 and/or the second trommel section 4 allows the wastes to be mixed and turned over, so that at least most of them, or still all of them, could enter into contact with the first separation wall 5 and/or the second separation wall 6 in order to be sorted.

For a better mixing of the wastes and to improve the sorting effectiveness of the sorting machine 1, each of the first trommel section 3 and/or the second trommel section 4 is designed to be rotated independently or not from each other, the independent rotation of the first trommel section 3 and/or the independent rotation of the second trommel section 4 and/or the dependent rotation of both being preferably performed in an alternating manner in one direction and in the other according to a desired frequency, around their respective longitudinal axes.

Advantageously, it is possible to choose a cylindrical shape, which allows the wastes, during the rotation of the trommel sections, to rub against each other so as to clean each other from the sticky wastes. Alternatively, it is possible, for example, to choose a prismatic shape with an octagonal base so as to make the wastes rebound on the walls, in order to enable a better separation of the wastes from each other.

Advantageously, the diameter of the first trammel section 3 and of the second trommel section 4 is comprised between 2 and 3 m.

Consequently, as illustrated in FIG. 1, the first series of separation orifices 7, 8 is preferably distributed over the entire circumference of the first separation wall 5, the second series of separation orifices 9 being distributed over the entire circumference of the second separation wall 6.

Preferably, and as illustrated in the figures, the separation orifices 7, 8 of the first series of separation orifices 7, 8 are distributed over the first separation wall 5 according to a first random meshing, the separation orifices 9 of the second series of separation orifices 9 being distributed over the second separation wall 6 according to a second random meshing. In this manner, the separation orifices 7, 8, 9 are disposed both in a first helix and in a cross second helix, which improves the sorting effectiveness during the circulation of the wastes in the first trommel section 3 and in the second trommel section 4, regardless of the direction of rotation of said trommel sections 3, 4.

Preferably, the first separation wall 5 and/or the second separation wall 6 is provided with vanes 22 for lifting the wastes circulating in the first trommel section 3 and/or in the second trommel section 4, respectively. Preferably, each of the lifting vanes 22 is disposed in the longitudinal direction of the trommel sections 3, 4 so as to drive, lift and stir the wastes during the rotation of said trommel sections 3, 4. Advantageously, the lifting vanes 22 are disposed randomly.

As illustrated in FIG. 1, the first trommel section 3 and the second trommel section 4 form one single one-piece trommel 3, 4 rotating around one single longitudinal axis X-X'-Y-Y', the output end of the first trommel section 3 being directly connected to the input end of the second trommel section 4. In this preferred case, the trommel section 3, 4 are integral with each other, and form one single drum.

In the preferred case represented in FIG. 1, the sorting machine 1 comprises three load bearings 23 allowing supporting and/or driving in rotation the unique trommel, two load bearings 23 being placed at the ends of the unique trommel, the latter being placed substantially medially between the two others. For example, the load bearings 23 correspond to bearings, and/or to drive means such as a gear wheel or a drive pulley. Advantageously, the medial load bearing 23 allows avoiding any risk of bending of the unique trommel 3, 4, in particular in the case where its total length is considerable and where the amount of wastes therein is particularly massive.

Alternatively, according to another preferred variant which is not represented in the figures, it is possible to consider that the first trommel section 3 and the second trommel section 4 form two independent trommels, the sorting machine 1 including means for transferring the residual second fraction of wastes 14 from the first trommel section 3 to the second trommel section 4.

Preferably, the first trommel section 3 comprises a transfer output for the residual second fraction of wastes 14, the second trammel section 4 comprising a secondary input for the residual second fraction of wastes 14. Advantageously, the secondary input is connected to the transfer output, so that the wastes could circulate from the first trommel section 3 to the second trommel section 4. Preferably, the sorting machine 1 is designed so that the residual second fraction of wastes 14 falls, by gravity, from the first trommel section 3 into the second trommel section 4.

For purely illustrative purposes, the variant represented in the figures may operate in the manner described hereinafter.

The unique trommel 3, 4 rotating in an alternating manner in one direction and in the other around its longitudinal axis, the mixture of wastes 2 to be sorted is introduced via the inlet 10.

The mixture of wastes 2 first circulates in the first trommel section 3 so as to be separated:

- on the one hand, into a first fraction of wastes 13, which passes throughout the first separation wall 5 so as to fall in the first hopper 12, and
- on the other hand, into a residual second fraction of wastes 14, which remains inside the unique trommel 3, 4 and evolves in the direction of the second trommel section 4.

When reaching the second trommel section 4, the residual second fraction of wastes 14 is sorted again, and is separated in this instance:

- on the one hand, into a subfraction of small-sized wastes 15, which passes throughout the second separation wall 6 so as to fall in the second hopper 17, and
- on the other hand, into a subfraction of large-sized wastes 16, which is discharged from the second trommel section 4 by the discard hopper 21, so as to fall in the discharge hopper 18.

Thus, the fractions and subfractions of wastes 13, 15, 18 recovered separately in the hoppers 12, 17, 18 can be treated separately, despite the very large heterogeneity of the initial mixture of wastes 2.

Preferably, the sorting machine 1 described hereinabove may be integrated into a more general method for treating wastes, in particular for performing a step E1 of the latter, as illustrated in FIG. 2.

The treatment method preferably includes the step E1 during which the mixture of wastes 2 is separated into a first fraction of wastes 13 the size of which is smaller than about 180 mm, preferably smaller than 140 mm, and a residual second fraction of wastes 14.

Advantageously, step E1 is performed by means of a sorting machine 1 described hereinbefore.

By «size», is meant, in a general manner, a spatial dimension of the waste along its largest length, or a characteristic dimension. By «size» of a waste, is meant a geometric dimension characteristic of an individual waste, which allows it, for example, to pass throughout a mesh with a corresponding size if the size of the waste is smaller than the size of the mesh, or, on the contrary, prevents it from passing if the size of said waste is larger than the size of said mesh.

By «residual second portion of wastes», is meant the remaining portion of wastes, which has not met the separation criteria of the first portion of wastes 13, in this instance the size criterion. However, in the context of the invention, there is nothing to prevent that wastes which would have met the separation criterion, in this instance the size criterion, of the first portion of wastes 13 could also exist in the residual second portion of wastes 14. For example, the residual second portion of wastes 14 may contain wastes the size of which is smaller than 50 mm.

In this manner, the first fraction of wastes 13 is advantageously formed by wastes presenting an average volumetric mass heavier than the wastes of the residual second fraction of wastes 14, to the extent that, in practice, the size of the wastes with the heaviest volumetric mass is preferably smaller than 180 mm.

According to the invention, the sorting method for sorting a mixture of wastes 2 is characterized in that the mixture of wastes 2 is introduced into a first trommel section 3 provided with a first separation wall 5 the first length L1 of which is at least equal to 1.05 times, preferably at least 1.10 times, still more preferably at least 1.12 times the second length L2 of the second trommel section 4 in which the residual second fraction of wastes 14 is passed.

Preferably, the step E1 of the method therefore includes a separation of the wastes the size of which is small enough, the volumetric mass of which is the heaviest, the dynamic inertia of which is the highest, the most sticky, fat, dirty and moist wastes of the mixture of wastes 2, so as to form the first fraction of wastes. Thus, the latter is advantageously formed at least by most of the wastes presenting such properties. Preferably, in this instance, the first fraction of wastes 13 therefore mostly concentrates organic and/or biodegradable wastes, which present the aforementioned properties most of the time.

Upon completion of this first separation performed at step E1, the first fraction of wastes 13 and the residual second fraction of wastes 14 may be treated more easily in the following steps of the method, in particular to the extent that, at this stage, the wastes of the residual second fraction of wastes 14 are cleared from most of the organic and/or biodegradable, sticky, dirty and foul wastes.

Preferably, the wastes of the first fraction of wastes 13 have a size smaller than about 110 mm, and are separated by means of the previously described sorting machine 1.

Advantageously, the method includes, upon completion of step E1 and simultaneously with the latter, a step E4 of separating the residual second fraction of wastes 14 into a subfraction of large-sized wastes and a subfraction of small-sized wastes 15, the subfraction of large-sized wastes being formed by wastes the size of which is larger than the subfraction of small-sized wastes 15. Preferably, the subfraction of large-sized wastes is formed by wastes the size of which is larger than about 330 mm, the subfraction of small-sized wastes 15 being formed by wastes the size of which is smaller than about 330 mm. Step E4 may also be performed by means of the sorting machine 1, as described hereinbefore.

Preferably, the treatment method includes a step E5 of manual sorting of the subfraction of large-sized wastes 16, allowing separating, on the one hand, the contained recyclable wastes 26 and, on the other hand, the contained non-recyclable wastes 27. Advantageously, the manual sorting is made possible at this stage, to the extent that the wastes are with a considerable size, devoid of small-sized wastes and of most fines. In addition, the wastes are advantageously devoid of most of the bonding and foul matter formed by the biodegradable matter, which makes the manual sorting possible. In particular, the manual sorting allows separating, from the subfraction of large-sized wastes 16, metallic wastes 26A, plastic wastes, large-sized electronic wastes, cardboard packages, etc.

The wastes recognized as recyclable wastes during the manual sorting are advantageously sent towards a recycling step W, as described hereinafter. The residual wastes which are not separated for recycling will advantageously be sent towards a refuse-derived fuel production step X, whether they are actually recyclable or non-recyclable.

Preferably, the treatment method includes a step E6 of automated sorting of the subfraction of small-sized wastes 15, allowing separating, on the one hand, the contained recyclable wastes 26 and, on the other hand, the contained non-recyclable wastes 27. Preferably, the subfraction of small-sized wastes 15 are adapted to an automatic sorting, the small-sized wastes 15 being too light to be manipulated for example by sorting apparatuses.

Preferably, step E6 includes a first substep E61 of separating the metallic wastes 26A contained in the subfraction of small-sized wastes 15, for example by means of an electromagnetic separator and/or an eddy current separator, so as to separate at least most of the metallic wastes 26A contained in said subfraction of small-sized wastes 15, the metallic wastes 26A forming at least most of the recyclable wastes 26. Thus, the metallic wastes 26A may advantageously be extracted from the subfraction of small-sized wastes 15, to the extent that said subfraction of small-sized 15 is preferably substantially devoid of sticky biodegradable wastes.

Preferably, step E6 includes a second substep E62 of separating the subfraction of small-sized wastes 15 into a flow of substantially flat wastes and a flow of substantially volume-shaped wastes. In this manner, the two flows of wastes may be directed towards sorting machines adapted to the morphology of the contained wastes.

By «substantially flat wastes», are meant wastes extending in a generally flat fashion, such as for example newspapers, papers, various plates of plastic material. Advantageously, the term «substantially flat wastes» also encompasses volume-shaped wastes which are soft enough, or with a mechanical strength which is low enough to allow flattening or compacting them easily, for example some cardboard boxes.

By «substantially volume-shaped wastes», are meant wastes which extend in three dimensions in the space, which may be hollow, and which resist compaction more than substantially flat wastes, and which are more rigid, or more solid. As example, the substantially volume-shaped wastes may comprise plastic or glass bottles, plastic boxes, vials and various containers.

Preferably, this substep E62 is performed by means of a ballistic belt separator (not represented). Preferably, the ballistic belt presents an inclination with respect to the horizontal so as to form a slope, the rolling strip being designed to generate a forward motion in the ascent direction of the slope. Advantageously, the substantially volume-shaped wastes are intended to roll and rebound on the ballistic belt by gravity so as to descend the slope in the direction of a lower recovery means such as a bin or a conveyor, optionally integrating a glass trap. In turn, the substantially flat wastes are preferably driven upwards of the slope by the forward motion of the belt, towards an upper recovery means, for example another conveyor, so that the substantially flat wastes and the substantially volume-shaped wastes are separated.

Advantageously, the fine particles which are likely to be contained in the subfraction of small-sized wastes 15 adhere to the ballistic belt (the latter may possibly be humidified in order to amplify this effect), and may advantageously be scraped and recovered for example by means of a tungsten-made strip scraper mounted on said belt. Advantageously, the rolling strip of the ballistic belt may present elastic properties so as to enable the rebound of substantially volume-shaped wastes.

Preferably, the ballistic belt is combined with an accelerator belt mounted upstream, allowing accelerating the subfraction of small-sized wastes 15 so that the latter reach the ballistic belt of the ballistic belt separator with a predetermined speed.

Preferably, step E6 includes a third substep E63 of robotized sorting, on the one hand, of the flow of substantially flat wastes and, on the other hand, of the flow of substantially volume-shaped wastes, so as to separate each of said flows from the recyclable wastes 26 and non-recyclable wastes, the third substep E63 being performed upon completion of the second substep E62. Advantageously, will be chosen sorting robots distinct and adapted respectively to sort, on the one hand, substantially flat wastes and, on the other hand, substantially volume-shaped wastes. Preferably, the sorting robots are designed to separate the recyclable wastes from the substantially flat wastes and from the substantially volume-shaped wastes by recognizing the latter, in particular by optical signature recognition, allowing in particular the sorting robot to detect the material of the waste to be sorted. Advantageously, the recyclable wastes recognized by the sorting robots will be sent towards a recycling step W. Advantageously, the non-recognized wastes, preferably including a small proportion of recyclable wastes and a major proportion of non-recyclable wastes, will be sent towards a refuse-derived fuel production step X.

After sorting by the sorting robots, before the recycling step W, the recyclable wastes may advantageously undergo a step T of the treatment method, during which non-ferrous metallic wastes are separated from the recyclable wastes, for example by means of an eddy current separator. At this stage of the method, the non-ferrous metallic wastes are formed for example by aluminum wastes, or still by food-grade flexible packages containing an aluminum sheet.

Advantageously, the distinct flows of substantially volume-shaped wastes and substantially flat wastes are conveyed by means of a set of conveyor belts to the sorting robots, the set of conveyor belts being designed to spread out and distribute the wastes so that almost no waste is superposed on top of another when said wastes arrive at the level of the sorting robots. Thus, the effectiveness of sorting by means of robots is advantageously improved.

Preferably, the substeps E61, E62 and E63 are performed successively in this order.

Preferably, the treatment method of the invention also includes a step E2, performed subsequently to step E1, during which the first fraction of wastes 13 is subjected to a composting process so as to compost, at least partially, the contained biodegradable wastes.

Thus, step E2 preferably aims to valorize the first fraction of wastes 13, and in particular to convert the contained biodegradable wastes into a mixture of refined wasted 28, so that the mixture of refined wastes 28 preferably forms a compost complying with the standard NF U 44-051. The standard NF U 44-051 of 2006, named «Organic amendments—Denominations, specifications and markings», is a French standard.

Advantageously, the composting process of step E2 includes the following successive steps:

Step A: the first fraction of wastes 13 is subjected to a first composting cycle so as to compost, at least partially, the biodegradable wastes of said first fraction of wastes 13, and to obtain a mixture of pre-composted wastes 2, Step B: the mixture of pre-composted wastes 2 is subjected to a drying so as to obtain a mixture of dried wastes 2, Step C: the mixture of dried wastes 2 is separated into at least one portion of heavy wastes 25 and one portion of light wastes, the portion of heavy wastes 25 being formed by wastes with a volumetric mass heavier than the wastes of the portion of light wastes, Step D: the portion of light wastes is subjected to a second composting cycle so as to compost, at least partially, the contained biodegradable wastes, and to obtain a mixture of refined wastes 28, in particular a compost.

Advantageously, step E2 includes the treatment of the first fraction of wastes 13 by two successive composting cycles separated by a step of drying the first fraction of wastes 13 upon completion of the first composting cycle in order to facilitate the separation and the easier refining of the first fraction of wastes 13. Thus, even if the first fraction of wastes 13 is particularly heterogeneous and presents numerous undesirable wastes which are not likely to be treated by composting, it is possible to refine the latter through step E2 so as to obtain refined wastes 28 the value of which is higher than the value of the initial mixture of wastes.

By «composting», is meant, in the context of the invention, a biological process of conversion and valorization of the organic wastes, and in particular the biodegradable wastes contained in the first fraction of wastes 13, by promoting and/or accelerating the natural biodegradation process. Preferably, the composting cycles of step E2 allow converting at least a portion of the first fraction of wastes 13 into a stabilized product, hygienic, rich in humic compounds, preferably into a compost. By «composting», is meant a composting, for example traditional or industrial, involving in particular the action of micro-organisms in order to degrade and putrefy wastes of the first fraction of wastes 13, these micro-organisms being naturally present in the first fraction of wastes 13 and/or added to the first fraction of wastes 13, and/or brought to multiply in the first fraction of wastes 13. In particular, the present composting involves an aeration of the first fraction of wastes 13, and/or a regulation of the humidity of the first fraction of wastes 13 (for example by adding water and/or by reintroducing in the first fraction of wastes 13 composting juices 11 emitted by the latter), and/or an addition of micro-organisms to the first fraction of wastes 13 and/or an addition of structurants 17C in order to stimulate the composting process, and/or a supply of light, for example solar light.

Preferably, step A corresponds to, or comprises, a phase of degradation of the wastes, in particular the biodegradable wastes, whereas step C corresponds to, or comprises, a phase of maturation of the wastes, in particular the biodegradable wastes, so as to obtain the mixture of refined wastes 28, the latter advantageously forming the compost. The degradation phase is advantageously reflected by a proliferation of micro-organisms in the first fraction of wastes 13, whereas the maturation phase is preferably reflected by the progressive decrease of the amount of micro-organisms having proliferated during the degradation phase, and by the preservation of micro-organisms beneficial to the soils. The degradation and maturation phases may overlap each other, and even coincide with each other.

The invention also concerns, as such, a method for sorting a mixture of wastes 2 with heterogeneous sizes, shapes and consistencies, comprising at least biodegradable wastes and non-biodegradable recyclable wastes, a non-negligible portion of the mass of the mixture of wastes being formed by biodegradable wastes, for example at least 10% of the mass, and a non-negligible portion of the mass of the mixture being formed by non-biodegradable recyclable wastes, for example at least 10% of the mass, said sorting method being characterized in that, it includes the following successive steps:

- introducing the mixture of wastes 2 into a first trommel section 3, provided with a first separation wall 5 extending over a first axial length L1 and being provided with a first series of separation through orifices 7, 8,
- separating the mixture of wastes 2 into a first fraction of wastes 13 getting through said first separation wall 5 via the first series of separation orifices 7, 8 and into a residual second fraction of wastes 14, the mixture of wastes 2 circulating along said first wall so as to be separated,
- making the residual second fraction of wastes 14 pass from the first trommel section 3 to a second trommel section 4, provided with a second separation wall 6 extending over a second axial length L2 smaller than the first length L1, said second separation wall 6 being provided with a second series of separation through orifices 9,
- separating the residual second fraction of wastes 14 into a subfraction of small-sized wastes 15 getting through said second separation wall 6 by means of said second series of separation orifices 9 and into a residual subfraction of large-sized wastes 16, the subfraction of large-sized wastes 16 being formed by wastes the size of which is larger than the subfraction of small-sized wastes 15, the residual second fraction of wastes 14 being intended to circulate along said second wall so as to be separated.

Advantageously, the method of the invention may be performed by means of the sorting machine 1 described hereinabove.

POSSIBILITY OF INDUSTRIAL APPLICATION

The invention finds its industrial application in the design, the realization and the implementation of means for sorting of a mixture of wastes with heterogeneous sizes, shapes and consistencies, which mixture comprises biodegradable wastes and non-biodegradable recyclable wastes.

The invention claimed is:

1. A rotary machine (1) for sorting a mixture of wastes (2), the latter being of heterogeneous sizes, shapes and consistencies, the mixture of wastes (2) comprising at least biodegradable wastes and non-biodegradable recyclable wastes, said sorting machine (1) comprising:

- one first trommel section (3), provided with a first separation wall (5) extending over a first axial length (L1) and being provided with a first series of separation through orifices (7, 8) allowing separating the mixture of wastes (2) into a first fraction of wastes (13) getting through said first separation wall (5) via the first series of separation orifices (7, 8) and into a residual second fraction of wastes (14), the mixture of wastes (2) being intended to circulate along said first wall so as to be separated, wherein the first separation wall (5) has a first shape selected from the group consisting of a prism, a cylinder and a truncated cone, a height of the first shape defining a first longitudinal axis (X-X') of the first separation wall (5), the first separation wall (5) being rotated around the first longitudinal axis (X-X'); and
- one second trommel section (4), provided with a second separation wall (6) extending over a second axial length (L2) smaller than the first length (L1), said second separation wall (6) being provided with a second series of separation through orifices (9) allowing separating the residual second fraction of wastes (14) into a subfraction of small-sized wastes (15) getting through said second separation wall (6) via said second series of separation orifices (9) and into a residual subfraction of large-sized wastes (16), the subfraction of large-sized wastes (16) being formed by wastes the size of which is larger than the subfraction of small-sized wastes (15), the residual second fraction of wastes (14) being intended to circulate along said second wall so as to be separated, wherein the second separation wall (6) has a second shape selected from the group consisting of a prism, a cylinder and a truncated cone, a height of the second shape defining a second longitudinal axis (Y-Y') of the second separation wall (6), the second separation wall (6) being rotated around the second longitudinal axis (Y-Y').

2. The sorting machine (1) according to claim 1, characterized in that the first length (L1) is at least equal to 1.05 times the second length (L2), preferably at least 1.10 times, still more preferably at least 1.12 times.

3. The sorting machine (1) according to claim 1, characterized in that the sum of the first length (L1) and of the second length (L2) ranges from 10 to 20 m, and that the sorting machine (1) is designed to sort between 10 and 50 T/hr of a mixture of wastes (2).

4. The machine (1) for sorting a mixture of wastes (2) according to claim 1, characterized in that the first series of separation orifices (7, 8) comprises at least primary orifices (7) enabling at least contributing to the separation of the mixture of wastes (2) into the first fraction of wastes (13) and into the residual second fraction of wastes (14) by passage of the first fraction of wastes (13) throughout said primary orifices (7), the latter having a size adapted to prevent the passage of wastes with a size larger than 80 mm.

5. The machine (1) for sorting a mixture of wastes (2) according to claim 1, characterized in that the section of the primary orifices (7) is circular, with a diameter comprised between 85 mm and 95 mm, preferably about 90 mm.

6. The machine (1) for sorting a mixture of wastes (2) according to claim 4, characterized in that the first series of separation orifices (7, 8) also comprises secondary orifices (8) contributing to the separation of the mixture of wastes (2) into the first fraction of wastes (13) and into the residual second fraction of wastes (14) by passage of the first fraction of wastes (13) throughout said secondary orifices (8), the latter having a size adapted to allow the passage of wastes the size of which is comprised between 1 and 1.5 times the size of the wastes the passage of which is allowed by the primary orifices (7), the secondary orifices (8) being disposed upstream of the primary orifices (7), with regards to the flow direction of the mixture of wastes (2).

7. The machine (1) for sorting a mixture of wastes (2) according to claim 6, characterized in that the section of the secondary orifices (8) is circular, with a diameter comprised between 105 mm and 115 mm, preferably about 110 mm.

8. The machine (1) for sorting a mixture of wastes (2) according to claim 1, characterized in that the second series of separation orifices (9) comprises at least tertiary orifices (9) at least contributing to the separation of the residual second fraction of wastes (14) into the subfraction of small-sized wastes (15) and into the subfraction of large-sized wastes (16) by passage of the subfraction of small-sized wastes (15) throughout said tertiary orifices (9), the latter having a size adapted to prevent the passage of wastes with a size larger than at least 200 mm.

9. The sorting machine (1) according to claim 1, characterized in that the section of the tertiary orifices (9) is oblong-shaped, and said oblong section having a small diameter (Dp), and a large diameter (Dg).

10. The sorting machine (1) according to claim 9, characterized in that, for each tertiary orifice, the small diameter (Dp) is comprised between 200 and 240 mm, preferably about 220 mm, the large diameter (Dg) being comprised between 300 and 400 mm, preferably about 330 mm, the small diameter (Dp) being substantially perpendicular to the large diameter (Dg).

11. The sorting machine (1) according to claim 7, characterized in that the tertiary orifices (9) are distributed in successive rows along the second length (L2), by alternating at least:

a longitudinal row (19) of tertiary orifices (9), in which the large diameter (Dg) of the tertiary orifices (9) of the straight row is aligned in the direction of the second length (L2), and a transverse row (20) of tertiary orifices (9), in which the small diameter (Dp) of the tertiary orifices (9) of the transverse row (20) is aligned in the direction of the second length (L2).

12. The sorting machine (1) according to claim 1, characterized in that the first series of separation orifices (7, 8) is distributed substantially over the entire first length (L1) of the first trommel section (3), the second series of separation orifices (9) is distributed substantially over the entire second length (L2) of the second trommel section (4).

13. The sorting machine (1) according to claim 1, characterized in that the first series of separation orifices (7, 8) is distributed over the entire circumference of the first separation wall (5), the second series of separation orifices (9) being distributed over the entire circumference of the second separation wall (6).

14. The sorting machine (1) according to claim 1, characterized in that the separation orifices (7, 8) of the first series of separation orifices (7, 8) are distributed over the first separation wall (5) according to a first random meshing, the separation orifices (9) of the second series of separation orifices (9) being distributed over the second separation wall (6) according to a second random meshing.

15. The sorting machine (1) according to claim 1, characterized in that each of the first trommel section (3) and the second trommel section (4) is designed to be rotated, the rotation is performed in an alternating manner in one direction and in the other according to a desired frequency.

16. The sorting machine (1) according to claim 1, characterized in that the first separation wall (5) and/or the second separation wall (6) is provided with vanes (22) for lifting the wastes circulating in the first trommel section (3) and/or in the second trommel section (4), respectively.

17. The sorting machine (1) according to claim 1, characterized in that the first trommel section (3) and the second trommel section (4) form a single trommel (3, 4).

18. The sorting machine (1) according to claim 1, characterized in that the first trommel section (3) and the second trommel section (4) form two independent trommels, the sorting machine (1) including means for transferring the residual second fraction of wastes (14) from the first trommel section (3) to the second trommel section (4).

19. The sorting machine (1) according to claim 1, characterized in that at least 10%, preferably at least 20%, of the mass of the mixture is formed by biodegradable wastes, and at least 10%, preferably at least 20%, of the mass of the mixture is formed by non-biodegradable recyclable wastes (26).

20. A sorting method for sorting a mixture of wastes (2) with heterogeneous sizes, shapes and consistencies, comprising at least biodegradable wastes and non-biodegradable recyclable wastes, a non-negligible portion of the mass of the mixture of wastes being formed by biodegradable wastes, for example at least 10% of the mass, and a non-negligible portion of the mass of the mixture being formed by non-biodegradable recyclable wastes, for example at least 10% of the mass, said sorting method comprising the steps of:

introducing the mixture of wastes (2) in a first trommel section (3), provided with a first separation wall (5) extending over a first axial length (L1) and being provided with a first series of separation through orifices (7, 8), wherein the first separation wall (5) has a first shape selected from the group consisting of a prism, a cylinder and a truncated cone, a height of the first shape defining a first longitudinal axis (X-X') of the first separation wall (5), the first separation wall (5) being rotated around the first longitudinal axis (X-X');

separating the mixture of wastes (2) into a first fraction of wastes (13) getting through said first separation wall (5) via the first series of separation orifices (7, 8) and into a residual second fraction of wastes (14), the mixture of wastes (2) circulating along said first wall so as to be separated;

making the residual second fraction of wastes (14) pass from the first trommel section (3) to a second trommel section (4), provided with a second separation wall (6) extending over a second axial length (L2) smaller than the first length (L1), said second separation wall (6) being provided with a second series of separation through orifices (9), wherein the second separation wall (6) has a second shape selected from the group consisting of a prism, a cylinder and a truncated cone, a height of the second shape defining a second longitudinal axis (Y-Y') of the second separation wall (6), the second separation wall (6) being rotated around the second longitudinal axis (Y-Y'); and separating the residual second fraction of wastes (14) into a subfraction of small-sized wastes (15) getting through said second separation wall (6) via said second series of separation orifices (9) and into a residual subfraction of large-sized wastes (16), the subfraction of large-sized wastes (16) being formed by wastes the size of which is larger than the subfraction of small-sized wastes (15), the residual second fraction of wastes (14) being intended to circulate along said second wall so as to be separated.

21. The method for sorting a mixture of wastes (2) according to claim 20 characterized in that the mixture of wastes (2) is introduced into a first trommel section (3) provided with a first separation wall (5) the first length (L1) of which is at least equal to 1.05 times, preferably at least 1.10 times, still more preferably at least 1.12 times the second length (L2) of the second trommel section (4) in which the residual second fraction of wastes (14) is passed.

* * * * *